United States Patent [19]

Calcerano et al.

[11] Patent Number: 4,938,352

[45] Date of Patent: Jul. 3, 1990

[54] BATTERY DISPLAY PACKAGE

[75] Inventors: Victor A. Calcerano, Carmel, N.Y.; David F. O'Brien, North Woodstock, Conn.

[73] Assignee: Duracell Inc., Bethel, Conn.

[21] Appl. No.: 433,629

[22] Filed: Dec. 7, 1989

Related U.S. Application Data

[62] Division of Ser. No. 324,286, Mar. 16, 1989, Pat. No. 4,896,770.

[51] Int. Cl.[5] ..... B65D 85/62

[52] U.S. Cl. ..... 206/333

[58] Field of Search ..... 206/806, 333, 461, 459

[56] References Cited

U.S. PATENT DOCUMENTS

| | | | |
|---|---|---|---|
| D. 196,988 | 11/1963 | Willis et al. . | |
| D. 197,862 | 3/1964 | Willis et al. . | |
| D. 222,580 | 11/1971 | Nakakuma . | |
| D. 222,581 | 11/1971 | Nakakuma . | |
| 1,806,149 | 5/1931 | Daugherty . | |
| 2,979,192 | 4/1961 | Blonder . | |
| 3,206,020 | 9/1965 | Billingsley et al. . | |
| 3,863,837 | 2/1975 | Spiegel et al. | 206/806 X |
| 4,020,694 | 5/1977 | Mayhew | 206/461 X |
| 4,020,947 | 5/1977 | Roccaforte | 206/45.31 |
| 4,130,200 | 12/1978 | Iepson et al. | 206/333 |
| 4,723,656 | 2/1988 | Klerman et al. | 206/459 X |
| 4,749,082 | 6/1988 | Gardiner et al. | 206/461 X |

FOREIGN PATENT DOCUMENTS

| | | | |
|---|---|---|---|
| 2303676 | 11/1973 | Fed. Rep. of Germany | 206/806 |
| 2450751 | 11/1980 | France | 206/806 |
| 966253 | 8/1964 | United Kingdom | 206/806 |
| 2029360 | 3/1980 | United Kingdom | 206/463 |

*Primary Examiner*—William I. Price

*Attorney, Agent, or Firm*—Ronald S. Cornell; James B. McVeigh

[57] ABSTRACT

The present invention relates to a package for objects such as batteries, and more particularly for the display and sale of large, heavy cell sizes, such as "C" size and "D" size alkaline cells. The transparent package, having a rectangularly shaped perimeter similar to conventional two-cell packages, contains four such cells in diamond-shaped arrangement.

13 Claims, 2 Drawing Sheets

BATTERY DISPLAY PACKAGE

This application is a divisional of our copending application Ser. No. 07/324,286, filed on Mar. 16,1989 now U.S. Pat. No. 4,896,770.

The present invention relates to a package for objects such as batteries, and more particularly for the display and sale of large, heavy, cell sizes, such as "C" size and "D" size alkaline cells.

Battery packages which are in common use (other than the 9-volt) were originally designed for the sale of two items at a time. With the advent of the portable electronic device, the requirement for batteries has increased dramatically. It has therefore become desirable to package batteries in larger quantities. Accordingly, two-pack "AAA"-size battery packages became four-packs, and shortly thereafter the "AA"-size did the same.

Large cell sizes, however, such as "C" and "D" size batteries, pose particular display problems. For example, packages containing four "D" cells are very heavy as compared to smaller cell sizes such as "AA" or "AAA", and they tend to cause hanging packages to break free from the horizontal hanger elements from which they are commonly hung. Also, the larger cell sizes can not be contained in a package with four cells positioned side-by-side since the packages conventionally used for batteries are not of a size large enough to hold four cells therein; i.e. while the combined width of four "AA" or "AAA" cells does not exceed the width of a two cell package, this is not the case for the larger cells. For example, a conventional two-cell battery package is about 4 inches wide. Four "AA" cells positioned side-by-side are about 2¼ inches wide while four "D" cells positioned side-by-side are about 5 inches wide.

It is desirable to display the cells in a clear plastic housing so that they can be seen. While it is not possible to display four of them in side-by-side alignment because their combined width would exceed the width of conventional two cell battery packages, it is also undesirable to place the batteries behind one another in the display packages because then only the front cells would be seen by the customer, who might then incorrectly believe that the marked price for four cells was the price for only two.

Yet another problem encountered with larger cell sizes is that retailers would have to make special shelf or display rack adjustments in order to provide adequate space allowance.

It is therefore an object of the present invention to provide a package for the display and sale of four large size, heavy cells which overcomes the above identified problems.

The features and advantages of the present invention will be described with reference to the accompanying figures in which.

Figure 1:
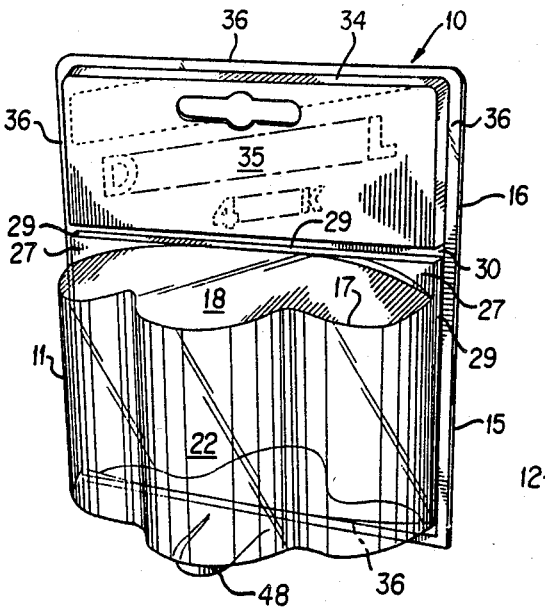
FIG. 1 shows a front view of a battery package, for holding "D" size cells, made in accordance with the present invention.

Referring now to FIG. 1 of the drawings, package 10 comprises a front and rear panels having lower and upper portions 15,16. Lower portion 15 includes a battery housing 11. The various part of the package are preferably integrally related and made from a transparent, heavy gage, thermoplastic material such as cold crack resistant polyvinyl chloride. The thermoplastic sheet stock is about 0.014 inches thick. Peripheral flange 27 extends outwardly from housing 11, and housing 11 is formed from a front blister 12 and a rear blister 14. The shape of peripheral flange 27 is preferably rectangular.

Peripheral flange 27 comprises an outer wall 29 directed back at a right angle from the flange's front surface. Outer wall 29 is formed along the entire perimeter of flange 27 whereby lower panel 15 has enhanced rigidity imparted thereto. As discussed more fully below, flange 27 also assists in aligning front and rear blisters 12, 14 during assembly of the package.

The front blister 12 and the rear blister 14 combine to provide an internal space for closely encompassing an arrangement of more than two cylindrical articles. In particular the articles are arranged in such a way that at least one article is behind another so that it would normally be precluded from view by the front row of articles if viewed directly from the front.

Front blister 12 is comprised of top 18, bottom 20, and means 22 connected therebetween and rear blister 14 is comprised of top 24, bottom 26, with means 28 connected therebetween. Front 12 and rear 14 blisters are adapted to hold the batteries therein. In particular, the package shown in FIGS. 1–6 is for holding four "D" size batteries in a configuration shown in the package on the left in FIG. 3. (A package for holding "C" size batteries is shown in FIG. 7 and will be discussed more fully below.) In a preferred embodiment, means 22 and means 28 are contoured to conform to the shape of the cells to be held within the cavity defined by blisters 12 and 14.

Figure 3:
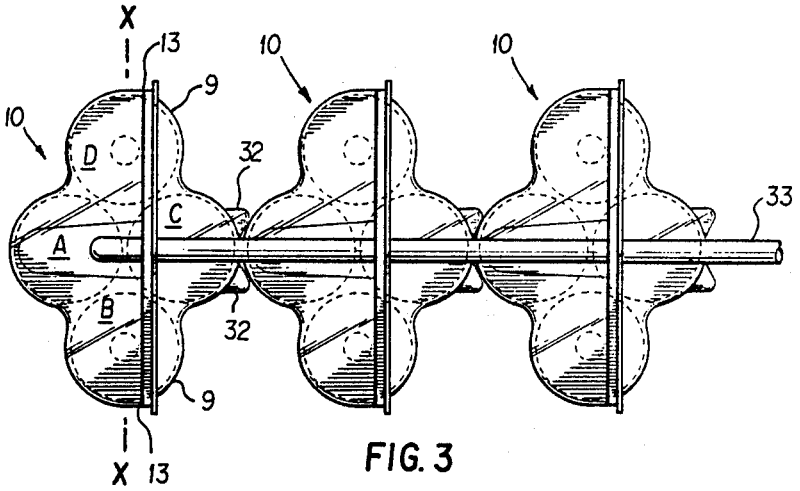
FIG. 3 shows a top view of a plurality of nested packages, made in accordance with the invention, and shown hanging from a display rod.
Figure 4:
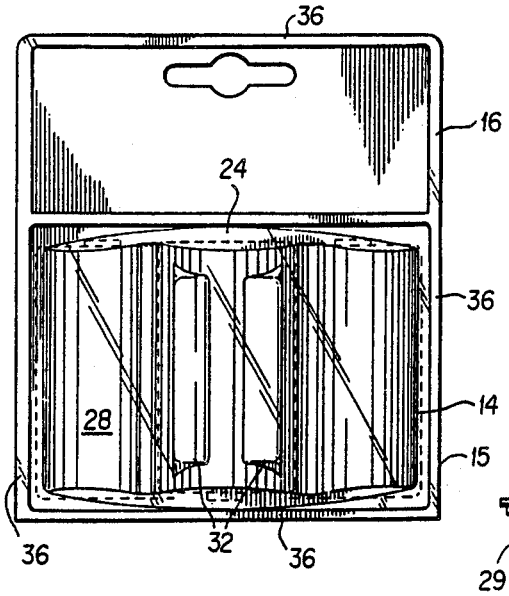
FIG. 4 shows a rear view of the package shown in FIG. 1.
Figure 5:
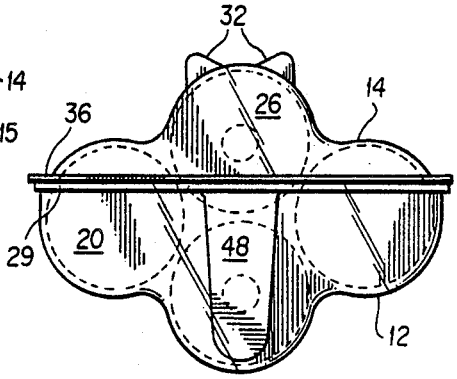
FIG. 5 shows a bottom view of the package shown in FIG. 1.

While the majority of the surfaces of means 22 and 28 are shaped to conform to the shape of the batteries, there is side-section 13 (see FIG. 3) on each side of means 22 which flares slightly away from conforming to the shape of the batteries. This is because, as discussed below, more than 50% of the mass of the batteries is held in front blister 12. As shown in FIG. 3, the surfaces of batteries "B" and "D" are turning inward at section 13 of means 22.

It is preferred that housing 11 holds the batteries in such a manner that they are not capable of moving around within the package, particularly in the top-to-bottom direction. Accordingly, means 28 closely follows the shape of the batteries to hold them firmly in place. In addition, the height of means 22 and 28 should be approximately equal to the height of the batteries, including the projecting positive end of the batteries. Such a height ensures that tops 18, 24 and bottoms 20,26 are closely associated with the projecting terminals and bottoms, respectively, of the cells within housing 11.

Figure 2:
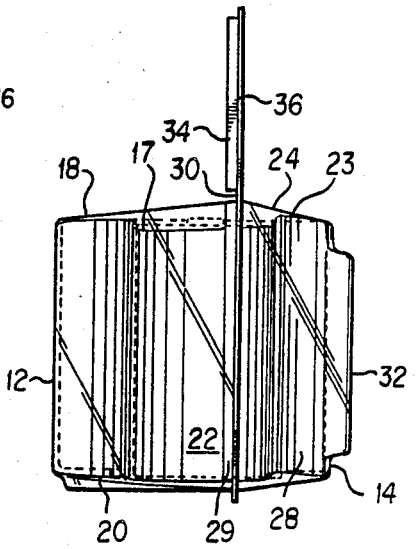
FIG. 2 shows a side view of the package shown in FIG. 1.

It is most preferred that means 22 and 28 have a height less than the height of the battery including the projecting terminal and slightly greater than the height of the battery excluding the projecting terminal. This height ensures that upper edges 17 and 23 of blisters 12 and 14, formed by the junction of top 18 with means 22 and top 24 with means 28 respectively, are closely associated with the upper rims of the batteries. This association has the housing 11 holding the batteries at their rims which is a firmer hold than at the projecting terminals. Since accommodation must be made for space occupied by the projecting terminals of the cells (shown in dotted outline in FIG. 2), tops 18 and 24 can have a concave or domed shape as shown in FIGS. 1 and 2 for providing the height needed.

Figure 2A:
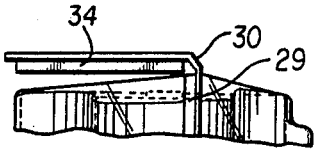
FIG. 2A shows the side view of FIG. 2 with the top panel of the package folded down.

Hinge means 30 extends horizontally between the upper and lower portions of the package and is adapted to permit panel 16 to fold downwardly toward the top 18,24 respectively of the front (preferably) or the rear blister portions of housing 11. When panel 16 is folded down towards housing 11 via hinge means 30, it allows a more efficient use of space. This is especially desirable for shipping the packages, and enables the packages to be shipped in shipping cartons of significantly smaller size. It is preferred that the width of hinge means 30 is slightly greater than the width of outer flange wall 29. This arrangement allows panel 16 to be folded over the top edge of outer flange wall 29 as shown in FIG. 2A.

The package shown in FIGS. 1-6 is designed for a specific arrangement of batteries, although the present invention is not limited to such arrangement. FIG. 3 shows the outline of how four batteries are held within the package. If flange 27 extended out from housing 11 in a plane passing vertically through the centers of cells "B" and "D" (the dashed line "X—X" in FIG. 3) the package would hang straight down because the mass of the batteries would be evenly distributed on both sides of hinge means 30. However, in this position panel 16, attached to hinge means 30, would obscure the view of cell "C" through the top 18 of the housing 11(particularly when panel 16 contains an opaque coupon as discussed below) and cells "A", "B", and "D" would block cell "C" from being viewed from the front. Thus, a consumer seeing the package might perceive that only three cells are contained in the package, and thereby led to believe that the price marked is for three batteries rather than for four.

Therefore, it is preferred that flange 27 extends out from housing 11 in a vertical plane parallel to and to the rear of the vertical plane "X—X", as shown in FIG. 3. Thus, hinge means 30 is attached to panel 15 in a plane which asymmetrically divides the mass of the batteries contained in housing 11. As shown in FIG. 2, panel 16 is thus attached such that more than half of the mass of the batteries is contained in front blister 12. In this manner cell "C" becomes visible, together with the other three cells, from the front of the package through top 18.

Having panel 16 attached as described immediately above causes housing 11 to hang with a slight tilt backwards because the mass of the batteries is unevenly dependent from hinge means 30 with more than 50% of the mass being in front blister 12. This backward tilt of housing 11 works in concert with engagement means 32 to align adjacent packages hung from the same display element 33 (see FIG. 3). Engagement means 32 is urged backwards against the foremost projecting cell in the package hanging immediately behind. Such engagement of contiguous packages aligns all of the packages and provides an orderly display as shown in FIG. 3. A preferred embodiment for engagement means 32 comprises two vertical protrusions which are attached parallel to each other on rear blister 14. The space between the ribs and their size are such that a portion of the foremost cell in the package immediately behind is accommodated therein.

It is preferred that panel 16 comprises an envelope portion 35 having peripheral outer wall 34 perpendicular thereto. It is preferred that peripheral outer wall 34 is about the same width as outer wall 29 of flange 27. Outer wall 34 imparts rigidity to panel 16 in the same manner that outer wall 29 imparts rigidity to panel 15. The space within envelope 35 is capable of containing a coupon having information imprinted thereon e.g. Trademark, warranty, rebate coupon, instructions and the like. Because the coupon is sealed within envelope 34 it can not be readily detached from the package. Outer wall 34 projects envelope 35 forward such that the information on the coupon is projected forward, whereby an appealing visual appearance is obtained.

Figure 6:
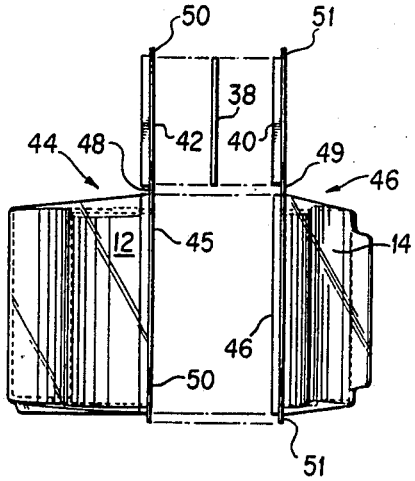
FIG. 6 shows an exploded view of a construction of the package shown in FIG. 1.
Figure 7:
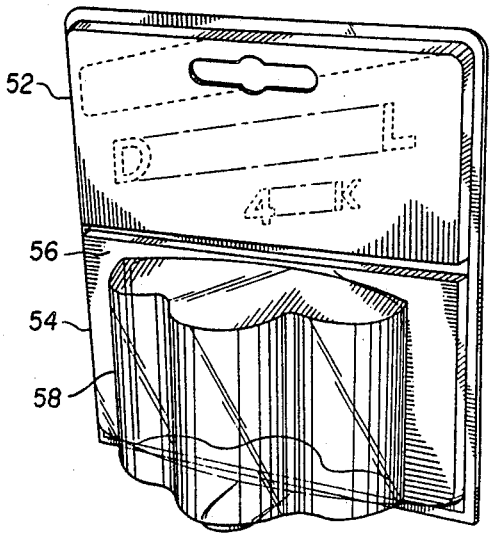
FIG. 7 shows a front view of a battery package, in accordance with the present invention, for holding "C" size cells.

FIG. 6 shows an exploded view of a preferred construction of package 10. Front member 44 comprises front blister 12, female counterpart 45 of flange 27 formed in the same direction as front blister 12, female counterpart 42 of envelope 35 formed in the same direction as front blister 12, horizontal section 48, and a perimeter flange 50. Rear member 46 comprises rear blister 14, male counter part 46 of flange 27 formed in the opposite direction as rear blister 14, male counterpart 40 of envelope 35 formed in the opposite direction as rear blister 14, horizontal section 49, and a perimeter flange 51.

Assembly of the packages is as follows. A sheet of cold crack resistant polyvinylchloride (PVC) has a $2\times3$ array of front members 44 formed therein. Another sheet of PVC has a $2\times3$ array of rear members 46 formed therein. The sheet comprising front members 44 is laid on a surface. Four batteries are placed into each of the six front blisters in the arrangement shown in FIG. 3. A coupon 38 is placed into each female envelope counterpart 42. The sheet comprising rear members 46 is placed over the battery filled front sheet. Alignment is simplified by the engagement of male flange counterpart 47 with female flange counterpart 45 and male envelope portion 40 with female envelope portion 42. Each of the front and rear members 44,46 are heat sealed together at their perimeters 50,51. The completed packages are then trimmed of excess plastic.

Heat sealing the package creates flange 36 around the perimeter of package 10. Foot member 48 (FIGS. 2 and 5) can be located on bottom 20 of front blister 12 to permit the package 10 to be stood on a surface without tipping forward from the uneven weight distribution of the cells in the package. Thus, the package rests on foot member 48 and flange 36 when the package is placed on a surface.

FIG. 7 shows a package for holding four "C" size cells. The package comprises lower panel 54 and upper panel 52. Lower panel 54 comprises housing 58 and flange 56. Housing 58 is shaped for holding four "C" cells in the same arrangement as the "D" cells shown in FIG. 3. It is desirable that both packages have similar outside dimensions so that they are interchangeable on the same display rack. To accomplish this, the "C" cell package has a relatively larger upper portion and smaller blister portion than the "D" cell package. Uniformity of package size for holding different sized cells provides a more uniform, visually appealing display when the packages are displayed together. All of the other features discussed above in reference to the package for "D" size cells are included, appropriately sized, in the package for holding "C" cells.

While the preferred plastic for constructing the package is cold-crack resistant polyvinyl chloride, other plastics are suitable. These include non cold crack polyvinyl chloride, propionate, polyethylene terephthalate glycol modified (PETG), and K-Resin. While the package described was made from a sheet stock about 0.014 inch thick, the thickness may range from 0.008 inch to 0.016 inch. Additionally, the front blister could be made from a material thicker than the material for the rear blister, because the rear blister holds less mass. For example, the sheet stock for the front could be 0.014 inch, while the rear could be 0.008 inch.

It is to be understood that deviations can be made from the specific description given above and still remain within the spirit and scope of the present invention as claimed.

What is claimed is:

1. A package for the sale and display of four cylindrical articles, said package comprising a housing for said articles formed by front and rear blisters, said housing being shaped to hold the articles therein with the articles standing upright in the housing, and wherein two articles are arranged, one behind the other, centered between the sides of the package, with the front of the rearward article substantially touching the back of the forward article; and the other two articles being located on opposite sides of the touching articles, with each of the said other two articles touching both of the centrally located articles; whereby the articles form a diamond-shaped arrangement having a front-to-rear dimension which is smaller than the side-to-side dimension.

2. The package of claim 1 and further including an upwardly extending panel portion attached to the housing from which panel the package can be hung from a display rack.

3. The package of claim 2 and further including horizontally disposed hinge means located in the upwardly extending panel contiguous to the housing; whereby the upwardly extending panel is capable of being folded downwardly.

4. The package of claim 3 wherein said housing, said panel, and said hinge means are all integrally related.

5. The package of claim 3 wherein the hinge means is attached to the housing in a plane which asymmetrically divides the mass of the articles contained in the housing, with the greater mass being at the front of the package.

6. The package of claim 3 wherein said housing, said panel, and said hinge means are all formed from a rigid, transparent, thermoplastic material.

7. The package of claim 1 and further including nesting means on the rear blister contiguous to the rearmost article whereby a plurality of packages hung from a display rack will be aligned by the interaction between adjacent packages of the nesting means on one package with the front blister of the package immediately behind.

8. The package of claim 1 wherein the front and rear blister each comprises a top, a bottom, and contoured means therebetween to closely hold the articles.

9. The package of claim 3 and further comprising a peripheral flange attached to the housing between the front and rear blisters, the outer edge of the flange being rectangular, and said hinge means being attached to an upper edge of said peripheral flange.

10. The package of claim 9 and further comprising a foot attached to the bottom of the front blister portion, said foot being adapted to enable the package to stand on a surface.

11. The package of claim 3 wherein said upper panel includes a rectangular envelope for containing a card having information written thereon.

12. The package of claim 1 wherein the articles are selected from the group consisting of four "D" size or four "C" size electrochemical cells.

13. The package of claim 6 wherein the package is made from a material selected from the group consisting of polyvinyl chloride, propionate, polyester terephthalate glycol modified, and K-Resin.

* * * * *